United States Patent [19]

Mugford et al.

[11] Patent Number: 4,586,696

[45] Date of Patent: May 6, 1986

[54] VEHICLE LIFTING JACK WITH INTEGRAL STOWABLE CRANK HANDLE

[75] Inventors: Lawrence W. Mugford, Mt. Clemens; John T. Bresnahan, Plymouth, both of Mich.

[73] Assignee: Chrysler Corporation, Highland Park, Mich.

[21] Appl. No.: 791,233

[22] Filed: Oct. 25, 1985

[51] Int. Cl.[4] ..... B66F 3/12

[52] U.S. Cl. ..... 254/122; 254/126; 254/DIG. 3; 254/1; 74/547

[58] Field of Search ..... 254/1, 122, 126, 419, 254/DIG. 3; 74/545, 547, 548

[56] References Cited

U.S. PATENT DOCUMENTS

| | | | |
|---|---|---|---|
| 1,286,161 | 11/1918 | Wagner | 74/547 |
| 1,558,114 | 10/1925 | Morrison | 74/547 |
| 1,612,446 | 12/1926 | Larson | 74/547 |
| 1,709,746 | 4/1929 | Schwerin | 254/122 |
| 3,771,385 | 11/1973 | Benoit et al. | 74/547 |

*Primary Examiner*—Robert C. Watson

*Attorney, Agent, or Firm*—Edward A. Craig

[57] ABSTRACT

A vehicle lifting jack of the actuating screw type is provided with an integral stowable crank. The crank comprises an L-shaped member pivotally connected to a crank handle. These elements are foldable together and may be swung over the lifting jack for storage. These elements are unfoldable for cranking the actuating screw to raise and lower the vehicle lifting jack. When unfolded, the crank is adjustable to a cranking position wherein the cranking element is in substantial alignment with the actuating screw to facilitate cranking.

3 Claims, 4 Drawing Figures

VEHICLE LIFTING JACK WITH INTEGRAL STOWABLE CRANK HANDLE

BACKGROUND OF THE INVENTION

One of the most effective ways of raising and lowering a screw operated vehicle lifting jack is by use of a crank. A crank provides a desired mechanical advantage for turning the screw and also results in ease of operation as a consequence of the simple cranking action.

Cranks are however, undesirably large and present a stowage problem in view of their bulky nature. Additionally, cranks have usually been provided as items separate from the jack. This has often resulted in loss of the crank.

The present invention provides the combination of a lifting jack with an integral stowable crank. The crank includes some features which have been proposed in the past but not included in a single combination. For example, the crank of the present invention is foldable. It is desirable to have a foldable crank in order that the crank is long enough to fit easily under a vehicle while at the same time being foldable for stowage. Foldable or telescoping cranks have been suggested in U.S. Pat. Nos. 1,326,451 issued Dec. 30, 1919 to H. S. Jillson et al, 1,286,161 issued Nov. 26, 1918 to A. F. Wagner, 2,557,465 issued June 19, 1951 to J. C. Rauscher, Sr., 1,193,126 issued Aug. 1, 1916 to E. M. Cumings and 1,361,593 issued Dec. 7, 1920 to A. B. Lang. However, these patents do not teach means for permanently connecting the crank to the lifting jack while at the same time permitting the crank to be swung into the jack for storage purposes.

It is also desired, for maximum turning torque, that the crank turning arm be in alignment with the jack screw and be connected to the jack screw by means of a universal-type joint connection to permit tilting of the crank away from the ground to avoid hitting the ground as the crank is turned and permitting the user to adopt a comfortable kneeling or bending position while manipulating the lifting jack. The desirability of this type of connection is taught in U.S. Pat. Nos. 1,468,771 issued Sept. 25, 1923 to E. E. Arnold, 1,901,915 issued Mar. 21, 1933 to M. H. Loughridge and 2,479,362 issued Aug. 16, 1984 to W. Jackson. However, again, the provision of a foldable crank swingable onto the jack for stowage is not suggested.

In accordance with the present invention, a combination as above described having the following four desirable features is provided:

1. A foldable crank.
2. Means permitting the folded crank to be swung into the jack for storage.
3. A permanent connection of the crank to the jack.
4. A universal-type connection of the crank to the jack.

SUMMARY OF THE INVENTION

An integral stowable crank is provided in combination with a vehicle lifting jack including an actuating screw. A crank bracket is fixedly secured to one end of the actuating screw. The crank bracket has an opening therein. The crank includes a generally L-shaped member and a manually engagable crank handle. The L-shaped member comprises a first relatively long arm pivotally connected at one end to the crank handle. The L-shaped member and crank handle are foldable together for storage and unfoldable for cranking the actuating screw to raise and lower the vehicle lifting jack. The L-shaped member has a second relatively short arm extending from the other end of the first arm to define the L-shape. The second arm passes through the opening in the crank bracket and has an enlargement at the terminus thereof. The enlargement prevents withdrawal of the first arm through the opening. Projecting means are provided on the second arm adjacent to the first arm leaving an unobstructed portion of the second arm between the projection means and enlargement. The crank bracket has slot means extending radially outwardly from the periphery of the opening. The second arm is rotatable to a position where the projection means is in alignment with the slot means and can be passed therethrough. The projection means is passed through the slot means in one direction to move the first arm closer to the crank bracket, with the second arm then being rotatable to a cranking position wherein the projection means is out of alignment with the slot means to thereby lock the second arm in a cranking position with the first arm being in substantial alignment with the actuating screw. The projection means is passed through the slot means in the other direction with subsequent movement of the second arm along the length of the unobstructed portion thereof to permit the crank to be swung over the lifting jack with the L-shaped member and crank handle being foldable together for storage with the lifting jack. The opening in the crank bracket is large enough to permit some tilting of the second arm therein and also rotation of the second arm therein to result in a universal-type joint connection.

IN THE DRAWING

BRIEF DESCRIPTION OF A PREFERRED EMBODIMENT

Figure 1:
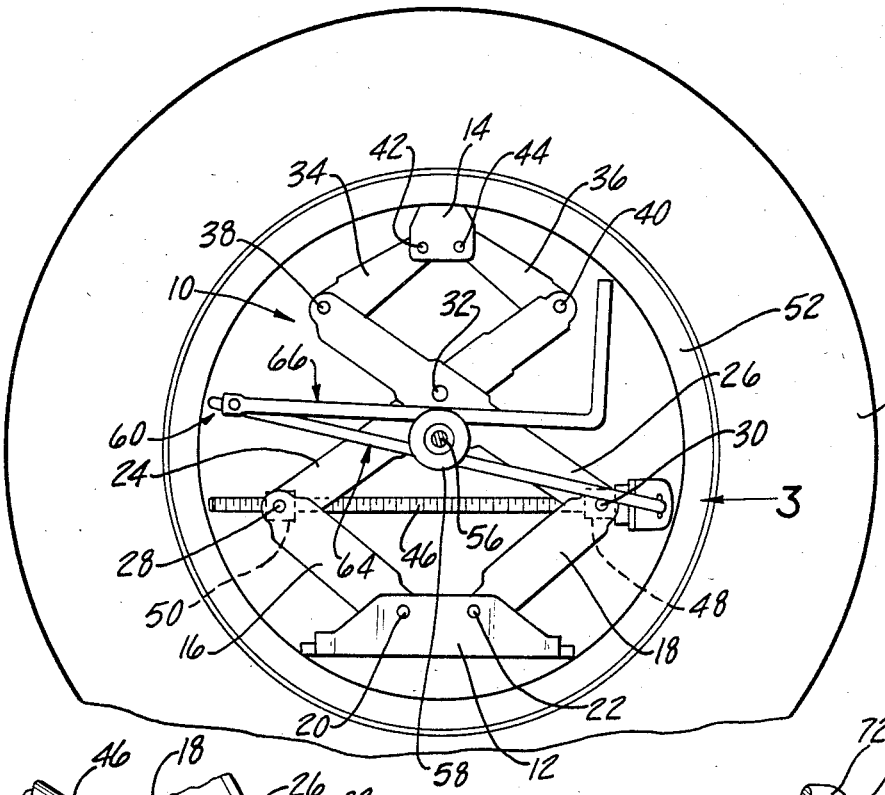
FIG. 1 is a plan view of a spare tire with one embodiment of the vehicle lifting jack with integral stowable crank handle illustratively stored therein.

Referring to FIG. 1, it will be noted that the lifting jack 10 comprises a conventional scissors-type construction. The jack 10 includes a base 12 and a lifting platform 14 interconnected by articulated lifting arms. First pairs of arms 16, 18 are pivotally connected to the base 12 at 20, 22. The pairs of arms 16, 18 are pivotally connected at their upper ends to second pairs of arms 24, 26 at 28, 30. These arms are pivotally connected at about their mid points to each other at 32. Finally, arms 34, 36 are pivotally connected to the arms 24, 26 at 38,40 and to the lifting platform 14 at 42, 44.

A screw 46 extends between blocks 48, 50 which are carried by pivots 28, 30. One end of the screw is journaled in block 48 while the other end threadingly engages internal threads provided in the block 50. As is conventional, turning of the screw 46 in one direction will cause the articulated arms to be extended resulting in the lifting platform 14 rising and when the lifting jack is mounted beneath a vehicle it will thus raise the vehicle and permit removal and replacement of a wheel. Turning of the screw 46 in the opposite direction results in the articulated arms collapsing to the configuration shown in FIG. 1 thus lowering the lifting platform 14 to disengage the vehicle and permit storage of the jack in the spare tire as shown in FIG. 1. As is well known, the spare tire comprises a rim 52 upon which the tire 54 is mounted. The rim 52 is concave and permits the lifting jack 10 to be received therein for storage purposes. A central post 56 is normally provided in the vehicle to pass through the spare tire for securement purposes. A ring 58 is secured to the crank 60. The post 56 also passes through ring 58. The post 56 is threaded at the top end and receives a nut to securely hold the spare tire and lifting jack in stored position as is conventional.

Figure 2:
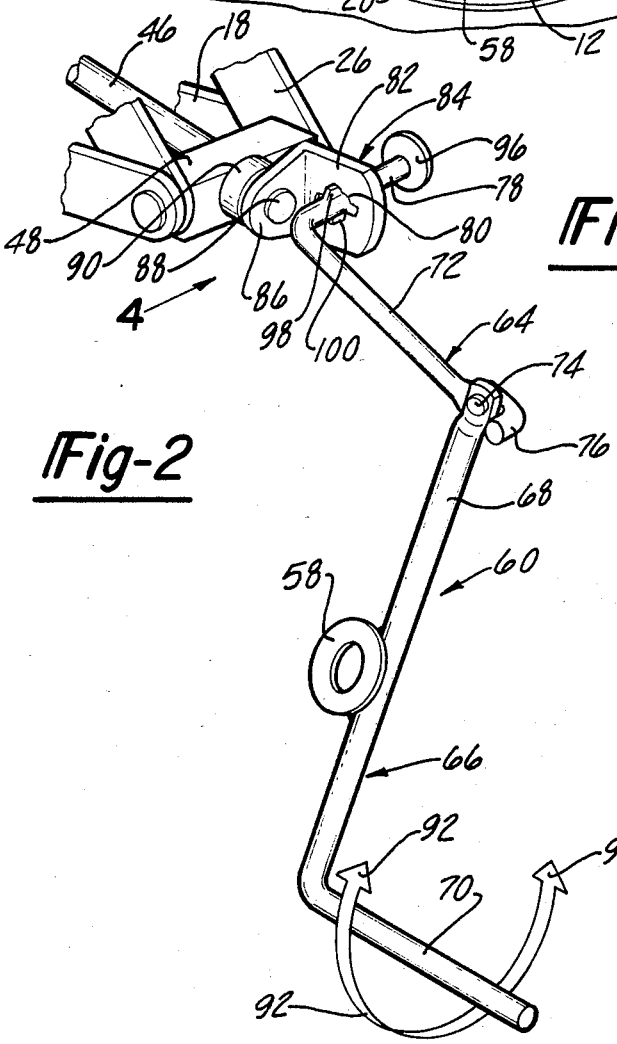
FIG. 2 is a view in perspective illustrating the vehicle lifting jack with the crank in cranking position.

The crank 60 includes a generally L-shaped member 64 and a crank handle 66. The crank handle 66 is also L-shaped having a cranking arm 68 and a manually engageable handle 70. The L-shaped member 64 has a first relatively long arm 72 which is pivotally connected at 74 to one end of the cranking arm 68. The arm 72 is turned over at 76 to limit movement of the crank handle 66 to the position shown in FIG. 2 wherein the cranking arm 68 is at substantially right angles to the arm 72. This is the most desirable cranking position. As previously noted, the ring 58 is welded to the arm 68. The L-shaped member 64 and crank handle 66 are foldable together for storage as shown in FIG. 1 and unfoldable as shown in FIG. 2 for cranking the actuating screw 46 to raise and lower the lifting platform 14 of the vehicle jack 10.

The L-shaped member 64 has a second relatively short arm 78 extending at approximately right angles from the longer arm 72 to define the L-shape. The arm 78 passes through an opening 80 provided in one leg 82 of a crank bracket 84. The crank bracket 84 has a second leg 86 extending at substantially rights angles from the leg 82. The leg 86 has an opening therethrough through which the end 88 of the actuating screw 46 passes. The end 88 of the screw is swaged and secured fixedly to the bracket 84 so the bracket can't rotate with respect thereto. A spacer 90 is provided on the end of the screw 46 between the bracket 84 and the block 48. Turning of the crank bracket 84 by means of the crank 60 causes a screw 46 to turn resulting in raising and lowering of the lifting jack platform 14 as previously described. The arrow 92 illustrates direction of movement of the crank 60. If the crank handle member 70 is turned in the direction of arrowhead 92 the lifting platform 14 will be raised while if the handle is turned in the direction of arrowhead 94 the lifting platform will be lowered.

An enlargement in the form of a ring 96 is welded to the terminus of the arm 78. The ring 96 prevents withdrawal of the arm 78 through the opening 80. Thus, the crank is integral with the lifting jack and cannot be lost with respect thereto. A first set of oppositely disposed projections 98, 100 are provided on the arm 78 closely adjacent to the arm 72. A second set of oppositely disposed projections 102, 104 are also provided on the arm 78 spaced a short distance from projections 98, 100. The second set of projections 102, 104 are also positioned adjacent the arm 72. An unobstructed portion of the second arm is left between the projections 102, 104 and the ring 96. A pair of oppositely disposed slots 106, 108 extending radially outwardly from the periphery of the opening 80. The arm 78 is rotatable in the opening 80 to a position where the projections 102, 104 are in alignment with slots 106, 108 and can be passed therethrough.

Figure 4:
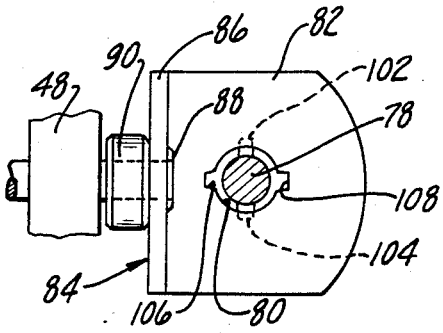
FIG. 4 is a view looking in the direction of arrow 4 of FIG. 2 illustrating the condition of the crank and crank bracket when the crank is in cranking position.

When it is desired to operate the lifting jack 10 to either raise or lower the lifting platform 14, the projections 102, 104 are passed through the slots 106, 108 in a direction to move the arm 72 closer to the crank bracket leg 82. The arm 78 is then rotated to a cranking position wherein the projections 102, 104 are out of alignment with the slots 106, 108 as shown in FIGS. 2 and 4. In this position, the projections 102, 104 cannot repass back through the slots 106, 108 and the crank 60 is effectively locked in a cranking position as illustrated in FIG. 2. In this position, the arm 72 is in substantial alignment with the actuating screw 46. This position is maintained by the sets of projections 98, 100 and 102 and 104. The sets of projections are spaced apart a distance somewhat larger than the thickness of the crank bracket leg 82 so that the fit will not be too tight. However, they do basically maintain the desired alignment which results in transmitting maximum turning torque from the crank 60 to the actuating screw 46.

Figure 3:
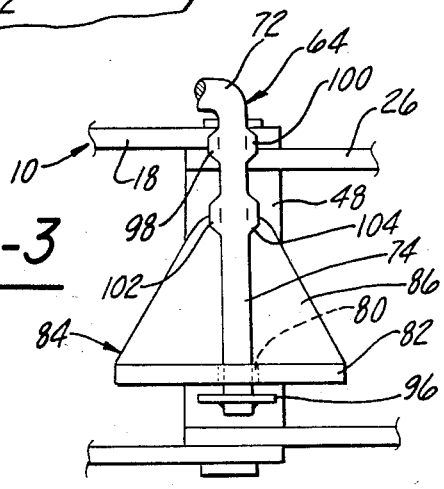
FIG. 3 is a view looking in the direction of arrow 3 of FIG. 1 illustrating the relationship of the crank and crank bracket when the crank is stowed.

When it is desired to store the lifting jack and crank, the arm 78 is again rotated until the projections 102, 104 are in alignment with the slots 106, 108. The projections then pass through the slots in the opposite direction. The arm 78 is continued to be moved along the length of the unobstructed portion thereof until contact made with the ring 96. The arm 72 and crank handle 66 are then positioned as shown in FIG. 3 to permit swinging out the crank over the lifting jack 10 to the storage position indicated in FIG. 1. The crank handle 66 is folded into the L-shape member 64 for storage with the lifting jack.

During use of the lifting jack 10, it is frequently desired to tilt the crank 60 upwardly for easier cranking action. The crank bracket 84 functions in a manner of a universal joint in that it permits tilting of the arm 72 in two directions. Firstly, the arm 72 may be tilted upwardly by rotating the arm 78 in the opening 80. This will result in upward tilting of the crank when the crank bracket 84 is in the position shown in FIG. 2. However, when the crank bracket leg 82 is swung to a position either under or over the actuating screw 46, such turning will not result in upward tilting of the crank. Therefore, the opening 80 has been provided with the diameter larger then the diameter of the arm 78 as may be seen in the FIG. 4. This permits direct tilting of the arm 78 within the opening 80. Thus, the crank may always be tilted upwardly as desired. In the cranking action, the arm 78 wedges against opposite sides or edges of the opening 80 to thereby apply the desired turning forces to the crank bracket 84.

Having thus described our invention, we claim:

1. In combination with a vehicle lifting jack including an actuating screw, an integral stowable crank, a crank bracket fixedly secured to one end of the actuating screw, the crank bracket having an opening therein, the crank including a generally L-shaped member and a manually engagable crank handle, the L-shaped member comprising a first relatively long arm pivotally connected at one end to the crank handle, the L-shaped member and crank handle being foldable together for storage and unfoldable for cranking the actuating screw to raise and lower the vehicle lifting jack, the L-shaped member having a second relatively short arm extending from the other end of the first arm to define the L-shape, the second arm passing through the opening in the crank bracket and having an enlargement at the terminus thereof, the enlargement preventing withdrawal of the first arm through said opening, projection means on the second arm adjacent to the first arm leaving an unobstructed portion of the second arm between the projection means and enlargement, the crank bracket having slot means extending radially outwardly from the periphery of said opening, the second arm being rotatable to a position where the projection means is in alignment with the slot means and can be passed therethrough, the projection means being passed through the slot means in one direction to move the first arm closer to the crank bracket with the second arm then being rotatable to a cranking position wherein the projection means is out of alignment with the slot means to thereby lock the crank in a cranking position with the first arm being in substantial alignment with the actuating screw, said projection means being passed through the slot means in the other direction with subsequent movement of the second arm along the length of the unobstructed portion thereof to permit the crank to be swung over the lifting jack with the L-shaped member and crank handle being foldable together for storage with the lifting jack.

2. The combination as set forth in claim 1, further characterized in that said projection means includes first projection structure closely adjacent to the first arm, second projection structure axially spaced from the first projection structure but also adjacent to the first arm, said first projection structure being passable through the slot means as set forth in claim 1, said first and second projection structure being in close abutting relationship with the crank bracket to prevent substantial movement of the second arm in either direction when the crank is in cranking position.

3. The combination as set forth in claim 1, further characterized in that said opening is of larger diameter than the diameter of the second arm thereby permitting tilting of the second arm within the opening to thereby impart the ability of two directional pivoting of the second arm to permit tilting of the crank.

* * * * *